United States Patent [19]

Chang

[11] Patent Number: 4,981,644

[45] Date of Patent: Jan. 1, 1991

[54] NICKEL-BASE SUPERALLOY SYSTEMS

[75] Inventor: Keh-Minn Chang, Schenectady, N.Y.

[73] Assignee: General Electric Company, Schenectady, N.Y.

[21] Appl. No.: 242,741

[22] Filed: Sep. 9, 1988

Related U.S. Application Data

[63] Continuation of Ser. No. 14,182, Feb. 11, 1987, abandoned, which is a continuation of Ser. No. 851,909, Apr. 11, 1986, abandoned, which is a continuation of Ser. No. 608,281, May 8, 1984, abandoned, Continuation-in-part of Ser. No. 518,789, Jul. 29, 1983, abandoned.

[51] Int. Cl.[5] ..... C22C 19/05

[52] U.S. Cl. ..... 420/442; 148/410; 420/445; 420/447; 420/448; 420/451

[58] Field of Search ..... 420/442, 445, 447, 448, 420/451; 148/410, 427, 428

[56] References Cited

U.S. PATENT DOCUMENTS 3,046,108 7/1962 Eiselstein ..... 420/448

OTHER PUBLICATIONS

H. L. Eiselstein, "Metallurgy of a Columbium-Hardened Nickel-Chromium-Iron Alloy", Huntington Alloy Products Div., The International Nickel Co., Inc., 1965, pp. 62-79.

E. L. Raymond, "Effect on Grain Boundary Denudation of Gamma Prime on Notch-Rupture Ductility of Inconel Nickel-Chromium Alloys X-750 and 718", Transactions of the Metallurgical Society of AIME, vol. 239, Sep. 1967, pp. 1415-1422.

P. S. Kotval, "Identification of the Strengthening Phase in 'Inconel' Alloy 718", Transactions of the Metallurgical Society, vol. 242, Aug. 1968, pp. 1764-1765.

D. F. Paulonis et al., "Precipitation in Nickel-Base Alloy 718" Transactions of the ASM, vol. 62, 1969, pp. 611-622.

Robert R. Irving, "Alloy 718: The Workhorse of Superalloys", Iron Age, Jun. 10, 1981, pp. 77-81.

*Primary Examiner*—Richard O. Dean

*Attorney, Agent, or Firm*—Paul E. Rochford; James C. Davis, Jr.; James Magee, Jr.

[57] ABSTRACT

Alloy compositions for nickel-base superalloys having the qualities of weldability, castability and forge-ability together with improved high temperature strength and rupture properties are disclosed. The weldability is improved by varying the Al, Ti, Nb and Ta content so as to insure that only the favorable $\gamma''$ precipitates are formed in the alloy. The high temperature properties of the alloy compositions are optimized by controlling the content of the major alloying elements Co and Cr. Preferably the alloy is substantially free of Fe.

10 Claims, 9 Drawing Sheets

YIELD STRENGTH, ksi
160
140
120
100
80
0.5
0.6
0.7
0.8
0.9
1.0
Rgdp
HW-18
AT % TOTAL = 2.5
HW-19
HW-17
HW-20
AT % TOTAL = 5.5
HW-16

Nb + Ta, at %
3
4
5
6
7
8
A
B
C
D
E
F
at % TOTAL = 8.0
at % TOTAL = 5.0
Rgdp = 0.95
Rgdp = 0.8
Rgdp = 0.62
HW-16
HW-17
HW-18
HW-19
HW-20
PE
PF
PG
CH-22

NICKEL-BASE SUPERALLOY SYSTEMS

This application is a continuation of application Ser. No. 014,182, filed Feb. 11, 1987 now abandoned; which was a continuation of application Ser. No. 851,909, filed Apr. 11, 1986 now abandoned; which in turn is a continuation of application Ser. No. 608,281, filed May 8, 1984 and now also abandoned which is a continuation-in-part of U.S. Pat. Application Ser. No. 518,789 - Chang, filed July 19, 1983 now abandoned.

BACKGROUND OF THE INVENTION

Nickel-base alloys both cast and forged are extensively used in the design of turbine components requiring weldability and high temperature capabilities, particularly those alloys providing a good combination of strength and ductility.

High-strength nickel-base superalloys, which usually contain aluminum and titanium as the major hardening elements are strengthened by the precipitation of gamma prime ($\gamma'$) phase with ordered fcc structure. When aluminum and titanium are partially or completely replaced by niobium or tantalum, a different precipitation phase can be produced having the ordered bct structure designated as gamma double prime ($\gamma''$). These $\gamma''$-strengthened alloy systems provide remarkably good tensile properties to intermediate temperatures.

Inconel 718 (IN 718), also referred to herein as the "base alloy", contains 25% by volume, more or less, of the $\gamma''$ phase as well as a small amount of ordered fcc $\gamma'$ precipitates. Investigations utilizing transmission electron microscopy have established that coherent $\gamma''$ precipitates are in disc-shape morphology with a {100} habit plane and have a cubic-cubic orientation relationship with the fcc matrix. More detailed characteristics of the phase chemistries of $\gamma'$ and $\gamma''$ are given in "Phase Chemistries in Precipitation-Strengthening Superalloy" by E.L. Hall, Y.M. Kouh, and K.M. Chang [to appear in Proc. Electron Microscopy Society of America, Aug. 1983]. The chemical combination of IN 718 alloy is set forth in TABLE I.

TABLE I

| Element | wt % | at % |
|---|---|---|
| Ni | bal. | bal. |
| Cr | 18.6 | 20.7 |
| Fe | 18.5 | 19.2 |
| Mo | 3.1 | 1.9 |
| Nb | 5.0 | 3.1 |
| Ti | 0.9 | 1.1 |
| Al | 0.4 | 0.9 |
| C | 0.04 | 0.19 |

Despite the relatively low volume fraction of strengthening phase (~25%) therein, IN 718 alloy, when forged and heat treated, has a room temperature yield strength of 165 ksi, which is higher than that of Udimet 700 (~140 ksi), which contains 45 volume % $\gamma'$ precipitate. This unique strength characteristic is responsible for the extensive use of IN 718 alloy in many turbine engine applications.

In addition to its strength and ductility capabilities, another notable property of IN 718 alloy is its excellent weldability, a characteristic which is apparently related to the sluggish precipitation kinetics of the coherent $\gamma''$ strengthening phase. This characteristic is of particular importance, because some welding processes are mandatory in the manufacture and repair of certain turbine engine components. Most precipitation-hardening superalloys, when welded, develop cracks in the heat affected zone and in the weld metal during welding or during post-weld heat treatment. Cracking accompanying the welding operation or subsequent heat treatment causes excessive and costly reworking of welded components and prevents optimum design latitude for components requiring joining during fabrication. IN 718 alloy is known to be the only non-susceptible alloy that also provides adequate strength. It is for that reason that IN 718 has been selected as the base alloy against which improvement is to be measured herein.

Unfortunately, the tensile strength of IN 718 alloy is relatively sensitive to temperature compared to conventional $\gamma'$ strengthened alloys. Further, the stress rupture life of IN 718 deteriorates rapidly at temperatures in excess of 1200° F. There is a continuing demand for new high-strength weldable, castable, forgeable superalloys having improved temperature capability for operation above 1200° F., because of the continuing increase in the turbine engine operating temperature.

The problem of providing weldability in a nickel-base cast alloy is addressed in U.S. Pat. No. 4,336,312 - Clark et al. In accordance With the Clark et al. invention, conventional nickel-base castable superalloys are modified by reducing the aluminum content and increasing the carbon content thereof. In addition, as-cast modified nickel-base alloy components are subjected to a pre-weld thermal conditioning cycle, which is believed by the patentees to result in a precipitate that retains adequate ductility within the grains.

U.S. Pat. No. 3,046,108 - Eiselstein is directed to a malleable, age-hardenable, nickel-chromium base alloy in which the emphasis is on the presence of "controlled and coordinated amounts of alloying elements" (column 1, lines 45 and 46). The composition of IN 718 lies within the teachings of this patent. The exclusion of iron, the inclusion of tantalum and the inclusion of cobalt are merely options.

Certain terminology and relationships will be utilized herein to describe this invention, particularly with respect to the precipitation hardening elements such as aluminum, titanium, tantalum and niobium. The approximate conversions of weight percent to atomic percent for nickel-base superalloys are set forth as follows:

Aluminum (wt %)×2.1=Aluminum (at %)
Titanium (wt %)×1.2=Titanium (at %)
Niobium (wt %)×0.66=Niobium (at %)
Tantalum (wt %)×0.33=Tantalum (at %)

The following are definitions useful in understanding this invention:

"at % TOTAL" is the term representing the total content of aluminum, titanium, niobium and tantalum expressed in atomic percent.

"$R_{gdp}$" is the value of the sum of the niobium and tantalum contents (in at %) divided by at % TOTAL. When this value is 0.62 or greater $\gamma''$ is the only precipitation strengthening phase present.

The following U.S. patents disclose various nickel-base alloy compositions: U.S. Pat. No. 2,570,193; U.S. Pat. No. 2,621,122U.S. Pat. No. 3,061,426; U.S. Pat. No. 3,151,981; U.S. Pat. No. 3,166,412; U.S. Pat. No. 3,322,534; U.S. Pat. No. 3,343,950; U.S. Pat. No. 3,575,734; U.S. Pat. No. 4,207,098 and U.S. Pat. No. 4,336,312. The aforementioned U.S. patents are representative of the many alloying situations reported to date in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for the metallurgist to predict accurately the physical and mechanical properties of a new combination of known elements even though such combination may fall within broad, generalized teachings in the art.

DESCRIPTION OF THE INVENTION

Major alloying modifications of the base alloy have resulted in new alloys for the production of weldable castings and, further, of weldable, castable, forgeable alloys heat treatable to produce an improvement of greater than 100° F. in high temperature capabilities over the base alloy. A number of criteria to provide weldability have been determined for this new alloy system: at % TOTAL is to be between about 5.0 and about 8.0; the value of $R_{gdp}$ is to be equal to or greater than about 0.62 and equal to or less than 0.95; the sum content of aluminum and titanium (i.e., Al+Ti) is to be equal to or less than about 3.0 at % and equal to or greater than about 0.5 at % and the sum content of niobium and tantalum (i.e., Nb+Ta) is to be equal to or greater than about 3.0 at % and equal to or less than about 7.5 at %, thereby assuring that the alloy will be free of gamma prime phase. In order to add to the weldability property certain desired high temperature capabilities (high temperature strength and stress rupture strength), it is preferred to eliminate iron as a constituent except insofar as it may be present as an impurity. Limited amounts of iron (i.e., less than about 5.0 wt %) may be tolerated realizing that some minor reduction in high temperature properties may be incurred. To optimize the increase in high temperature strength and stress rupture life afforded by this invention, Cr, Co and Ta are added in amounts ranging from about 18 wt % to about 22 wt % Cr, from about 8.0 wt % to about 14.0 wt % Co and a minimum of about 2.0 wt % Ta.

In its overall compositional definition, the nickel-base alloy of this invention contains (in wt %) about 12% to about 24% chromium, about 5% to about 20% cobalt, about 1% to about 8% from the group consisting of molybdenum, tungsten, rhenium and mixtures thereof, about 2.0% to about 23% tantalum, up to about 10.5% niobium, up to about 2.7% aluminum, up to about 3.7% titanium, about 0.003% to about 0.05% boron, up to about 0.10% carbon, up to 0.1% zirconium, up to about 5.0% iron, up to about 0.5% silicon, up to about 0.5% manganese and the balance essentially nickel. In respect to nickel the term "balance essentially" is used to include, in addition to nickel in the balance of the alloy, small amounts of impurities and incidental elements, which in character and/or amount do not adversely affect the advantageous aspects of the alloy. Molybdenum may be replaced in part or entirely by an equal weight amount of tungsten and/or rhenium. Iron is an undesirable element in alloys of this invention and its content level must not exceed about 5.0 wt %.

In a preferred overall compositional definition, the nickel-base alloy of this invention contains (in wt %) about 16% to about 24% chromium, about 8% to about 16% cobalt, about 1% to about 8% from the group consisting of molybdenum, tungsten and mixtures thereof, about 2.25% to about 22.5% tantalum, up to about 10.1% niobium, up to about 1.45% aluminum, up to about 2.54% titanium, about 0.005% to about 0.02% boron, up to about 0.04% carbon and the balance essentially nickel. The minimum content of Al+Ti is about 0.24% and the minimum content of Nb+Ta is about 4.70%. The maximum content of Al+Ti is about 2.54% and the maximum content of Nb+Ta is about 22.5%. Impurities, which may be present in the alloys of this invention, include iron, silicon, manganese, sulfur, copper and phosphorus. The maximum permissible concentrations of these elements as impurities are as follows:

| | |
|---|---|
| Iron | 1.00 wt % |
| Silicon | 0.35 wt % |
| Manganese | 0.35 wt % |
| Sulfur | 0.015 wt % |
| Copper | 0.30 wt % |
| Phosphorus | 0.015 wt % |

BRIEF DESCRIPTION OF THE DRAWING

The features of this invention believed to be novel and unobvious over the prior art are set forth with particularity in the appended claims. The invention itself, however, as to the organization, method of operation, and objects and advantages thereof, may best be understood by reference to the following description taken in conjunction with the accompanying drawing wherein:

MANNER AND PROCESS OF MAKING AND USING THE INVENTION

In the development of the base alloy, iron (18–20 wt %) was added to maximize room temperature yield strength. The main effect of introducing iron into the base alloy is to control the solubility of hardening elements at aging temperature. By not introducing iron the degree of supersaturation is reduced. This results in a reduction in the amount of precipitation phase, which can form, and thereby in a decrease of yield strength. It was found in the making of the invention disclosed herein that the decrease in supersaturation by leaving out the iron can be restored by adding more of the precipitate-forming elements. Thus, it has been found that tantalum, as well as niobium (columbium), can form the $\gamma''$ phase in nickel-base superalloys. About 1 at % of tantalum is sufficient to compensate for the decrease in yield strength caused by the removal of iron from the base alloy.

FORGINGS COMPARED

Figure 1:
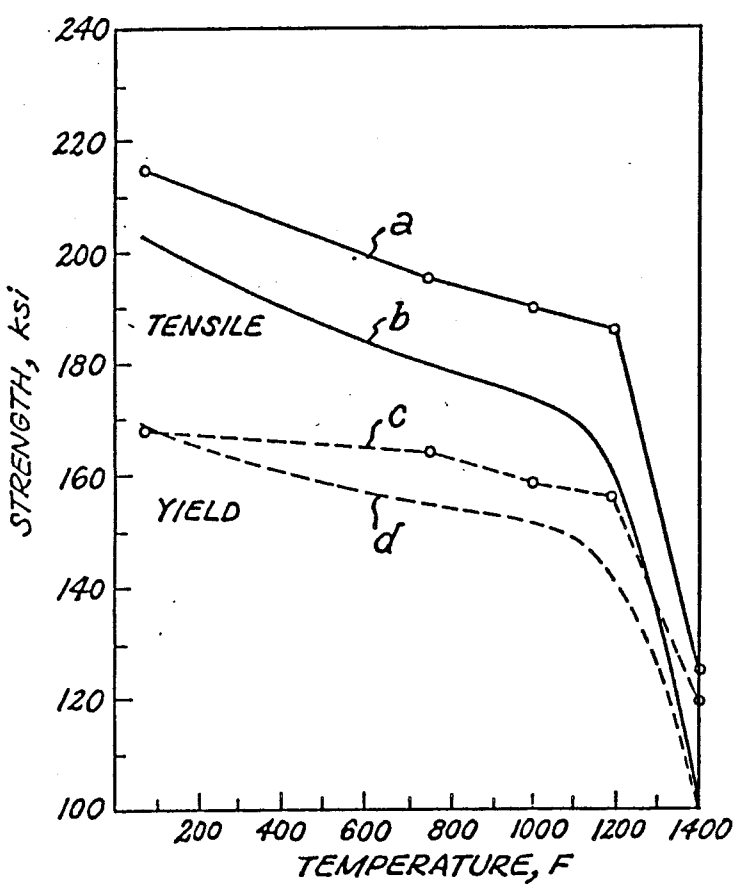
FIG. 1 is a graphic representation of measured comparative tensile and yield strengths (1) of the base alloy and (2) of the base alloy modified by removing iron and introducing 1 at % tantalum.

Measurements of the tensile properties of a forging of such an alloy (i.e., −Fe+1 at % Ta) over the temperature range from room temperature (i.e., 68°–70° F.) to 1400° F. are plotted in FIG. 1, ;which also includes the requisite data for the base alloy in the forged condition. The tensile strength and yield strength test results of the (−Fe+Ta) forging is represented by curves a and c, respectively. Curves b and d represent the tensile strength and yield strength, respectively, of the base alloy. Commercial forging practices were used.

As may be observed in FIG. 1, in the iron-free, tantalum-modified alloy system:

1. With the same room temperature yield strength, a higher ultimate tensile strength is developed whereby this alloy system can sustain more plastic deformation (i.e., curve a vs. curbe b).

2. With the same room temperature yield strength, a better strength level is attained at intermediate temperatures, i.e., the alloy system becomes less sensitive to temperature (i.e., curve c vs. curve d).

Extensive investigations were carried out to study the effects of individual alloying elements on the creep rupture properties of the base alloy forgings. Results of some of these investigations are shown in FIG. 2 wherein comparisons are made to the base alloy.

Figure 2:
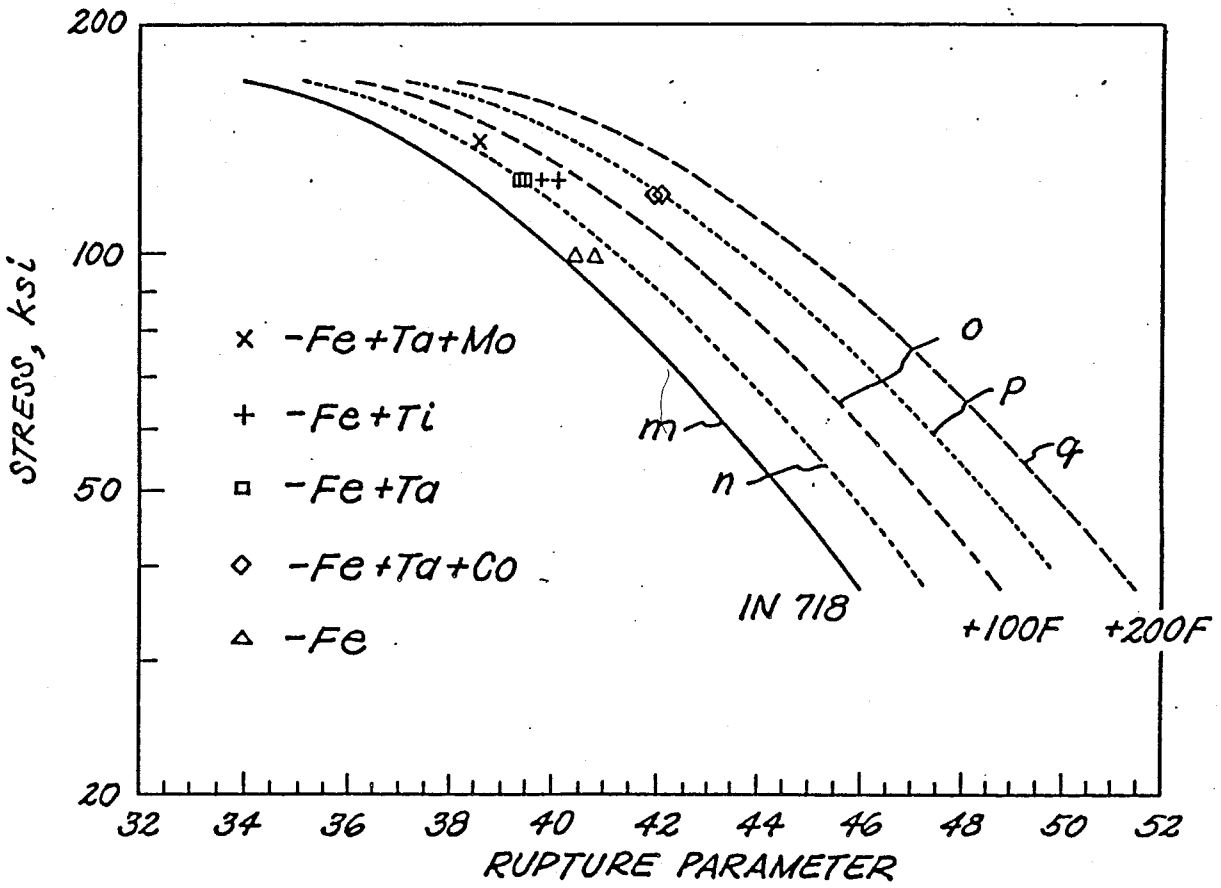
FIG. 2 is a graphic representation of investigations carried out to study the effect of alloying modifications of the base alloy on the creep rupture properties thereof.

Values along the vertical axis in FIG. 2 are values of rupture stress and values given along the horizontal axis are values of the Larson-Miller rupture parameter (P). This latter term is defined by the relationship:

$$P = (T + 460) \times (22 + \log t)/1000$$

where
$T$ is temperature (°F.)
$t$ is rupture time (hrs.).

The rupture properties of the base alloy forging is represented by curve m. By fixing t=100 hours, rupture curves n, o, p and q were plotted to provide a measure of whether or not an alloy being compared to the base alloy does, in fact, reflect improvement in performance at higher temperatures. As shown, the curves are plotted at 50° F. intervals. Test data from these investigations are superimposed on FIG. 2 and the extent of temperature improvement can be readily seen thereon.

The following conclusions have been reached from these data:

1. The addition of cobalt to the (−Fe+Ta) alloy in proper amounts can improve rupture life remarkably; thus, introducing 12 wt % cobalt provides more than an order-of-magnitude increase in stress rupture life at 1200° F., and 2. Increasing the hardening element content (e.g., Ti, Ta) can improve the alloy strength and subsequently increase rupture life. However, the improvement from adding titanium, or tantalum (without cobalt addition) is limited.

3. The refractory elements (Mo, W, Re) have very little effect on the stress rupture properties.

CASTINGS COMPARED

Because of the difficulties encountered in the case of forged specimens, but not in the case of cast specimens, in relating results obtained in tests on one composition to a different composition, the more comprehensive studies of the individual and combined effects of alloying elements were performed using as-cast alloys after appropriate heat treatments. Conclusions reached from the testing of cast alloys are applicable as well to forged alloys.

In the effort to accomplish the goal of modifying the cast base alloy to produce a new alloy system yielding (1) a weldable cast alloy and (2) a weldable cast alloy with improved high temperature (i.e., base alloy+100° F.) capabilities, four candidate alloy compositions were selected. A 3½ in. diameter, 30 lb. cylindrical ingot of each alloy was melted in a vacuum induction melting (VIM) furnace. The chemical compositions of these four alloys are set forth in TABLE II.

TABLE II

| Alloy Designation | Ni | Cr | Co | Mo | W | Al | Ti | Ta | Nb | Zr | B | C | at %* TOTAL | Weldability |
|---|---|---|---|---|---|---|---|---|---|---|---|---|---|---|
| CH-21 | bal. | 19.0 | 13.0 | 4.0 | — | 1.0 | 2.0 | — | 3.0 | 0.05 | 0.01 | 0.025 | 6.43 | good |
| | | 21.14 | 12.76 | 2.41 | — | 2.14 | 2.42 | — | 1.87 | 0.03 | 0.05 | 0.12 | | |
| CH-22 | bal. | 18.0 | 12.0 | 3.0 | — | 0.5 | 1.0 | 3.0 | 5.0 | — | 0.01 | 0.015 | 6.57 | excellent |
| | | 20.70 | 12.18 | 1.87 | — | 1.11 | 1.25 | 0.99 | 3.22 | — | 0.06 | 0.075 | | |
| CH-23 | bal. | 19.0 | 11.0 | 9.75 | — | 1.5 | 3.15 | — | — | 0.05 | 0.01 | 0.02 | 7.05 | marginal |
| | | 21.20 | 10.83 | 5.90 | — | 3.23 | 3.82 | — | — | 0.03 | 0.05 | 0.10 | | |
| CH-24 | bal. | 14.0 | 15.0 | 6.0 | 3.0 | 3.8 | 2.5 | — | — | 0.05 | 0.01 | 0.02 | 11.06 | poor |
| | | 15.42 | 14.58 | 3.58 | 0.93 | 8.07 | 2.99 | — | — | 0.03 | 0.05 | 0.095 | | |

*at % TOTAL = at % Al + at % Ta + at % Nb

The composition of each alloy is set forth for each alloy designation both as wt % (upper set of figures) and at % (lower set of figures). CH-21 is a low volume fraction $\gamma''$ precipitation strengthening alloy; CH-22 is a modification of the base alloy in that (a) iron has been deleted, (b) cobalt has been added (12 wt %) and (c) tantalum has been added (3 wt %). These changes in the cast base alloy improve the tensile and creep strengths at elevated temperature without diminishing the slow aging characteristics of the $\gamma''$ strengthening mechanism.

A macro (~0.225" thick) slice was cut from the center of each of the 3½ in. diameter ingots. A slice adjacent to the initial slice was cut from the bottom of the top half of each ingot and a slice adjacent to the initial slice was cut from the top of the bottom half of each ingot. The top half of each ingot was homogenized at 2150° F./4 hrs. and air cooled (A.C.). The bottom half of each ingot was hot isostatically pressed (HIP'ed) at 2125°-2150° F./2 hrs./15 ksi. Later, the slices were subjected to the same homogenization or hot isostatic pressing treatment and held for later studies. Small sections of each ingot half were heated to determine the $\gamma'$ or $\gamma''$ solvus temperature. One hour heat treatments were performed starting with 1900° F., the temperature being increased by 25° F. to a maximum of 2050° F. Optical metallographic examinations of these specimens revealed that the solvus temperatures of CH-21 and CH-22 were below 1900° F., while the solvus temperature of CH-23 was in the range of 2000° F.-2050° F. and the solvus temperature of CH-24 was above 2050+ F.

Based on the solvus temperature, the cast alloys were subjected to the following heat treatment: alloys CH-21 and CH-22 were heat treated in vacuum at 1950° F./1 hr. and then at 1400° F./5 hrs., followed by furnace cooling to 1200° F. at 100° F./hr. upon reaching 1200° F. the alloys were held at temperature for 1 hour. Alloy CH-23 was heat treated in vacuum at 2050° F./1 hr., air cooled and then heated at 1600° F./4 hrs., followed by air cooling. Alloy CH-24 was heat treated in vacuum at 2150° F./1 hr., air cooled, heated at 1600° F./4 hrs., air cooled and then heated at 1400° F./16 hrs. and air cooled.

Creep and tensile specimen bars were fabricated from the ingots after the heat treatment. The bars were fabricated from the ingots so that the central axis of the completed bars had been parallel to the cylindrical axis of of the ingot. The specimen geometry and dimensions were the same for each bar fabricated. Tensile properties were evaluated at room temperature and at 1300° F.; creep properties were evaluated at 1300° F./90 ksi.

The results of tensile and creep rupture tests are summarized in TABLES III and IV. The alloy CH-22 showed the best tensile properties at room temperature and at 1300° F. among the four experimental alloys evaluated.

TABLE III

| ALLOY | PROCESS CONDITION | SPEC NO. | TEMP. °F. | UTS (ksi) | 0.2% YS (ksi) | 0.02% YS (ksi) | ELONG (%) | R.A. (%) |
|---|---|---|---|---|---|---|---|---|
| CH21 | Homog. | 21-1T | R.T. | 145.3 | 107.9 | 97.2 | 21.9 | 23.8 |
| | HIP | 21-5B | R.T. | 147.3 | 108.4 | 99.8 | 27.4 | 27.5 |
| | Homog. | 21-5T | 1300 | 99.8 | 84.7 | 74.9 | 9.2 | 18.3 |
| | HIP | 21-1B | 1300 | 104.9 | 92.3 | 82.1 | 10.4 | 23.2 |
| CH22 | Homog. | 22-1T | R.T. | 160.9 | 145.0 | 130.5 | 12.6 | 27.5 |
| | HIP | 22-5B | R.T. | 157.4 | 141.8 | 128.7 | 15.7 | 24.0 |
| | Homog. | 22-5T | 1300 | 127.4 | 116.0 | 96.9 | 8.9 | 18.0 |
| | HIP | 22-1B | 1300 | 125.9 | 118.7 | 105.3 | 6.8 | 21.2 |
| CH23 | Homog. | 23-1T | R.T. | 114.7 | 96.3 | 87.5 | 7.7 | 10.6 |
| | HIP | 23-5B | R.T. | 118.8 | 97.8 | 91.4 | 8.6 | 6.7 |
| | Homog. | 23-5T | 1300 | 117.2 | 89.9 | 81.0 | 8.5 | 14.3 |
| | HIP | 23-1B | 1300 | 133.0 | 88.0 | 78.8 | 17.5 | 18.9 |
| CH24 | Homog. | 24-1T | R.T. | 137.5 | 113.8 | 103.9 | 7.9 | 14.7 |
| | HIP | 24-5B | R.T. | 137.1 | 110.2 | 104.7 | 12.3 | 15.5 |
| | Homog. | 24-5T | 1300 | 128.4 | 102.0 | 91.3 | 7.3 | 12.0 |
| | HIP | 24-1B | 1300 | 146.8 | 105.5 | 94.1 | 12.6 | 15.5 |
| IN | | | R.T. | 165.0 | 142.0 | 100.0 | 10.0 | 15.0 |
| 718 | | | 1200 | 132.0 | 119.0 | 90.0 | 6.0 | 15.0 |

NOTE:
Top half of each ingot was homogenized @ 2150° F./4 hrs. A.C.
Bottom half hot isostatic pressed (HIP) @ 2125-2150° F./2 hrs./15 ksi
Alloys CH21 and CH22 heat treated in vacuum @ 1950° F./1 hr. + 1400° F./5 hrs. furnace cool to 1200° F. @ 100° F./hr. + 1200° F./10 hr.
Alloy CH23 heat treated @ 2050° F./1 hr. A.C. + 1600° F./4 hrs. A.C.
Alloy CH24 heat treated @ 2150° F./1 hr. A.C. + 1600° F./4 hrs. A.C. + 1400° F./16 hrs. A.C.

TABLE IV

| ALLOY | PROCESS CONDITION | SPEC. NO. | P.O.L.* (%) | 0.2% HRS. | RUPT. HRS. | ELONG (%) | R.A. (%) |
|---|---|---|---|---|---|---|---|
| CH21 | Homog.*** | 21-4T | .2 | — | 26.5 | 4.6 | — |
| | HIP | 21-4B | .18 | 8.6 | 27.5 | 4.4 | 11.7 |
| CH22 | Homog. | 22-4T | 0 | 38.0 | 54.7 | 2.0 | 7.1 |
| | HIP | 22-4B | 0 | 59.0 | 97.1 | 2.8 | 6.3 |
| CH23 | Homog. | 23-4T | 0.3 | — | 95.0 | 4.2 | 6.3 |
| | HIP | 23-4B | 0.33 | — | 56.1 | 3.2 | 2.4 |
| CH24 | Homog. | 24-4T | 0 | ** | 22.8 | 1.6 | 8.7 |
| | HIP | 24-4B | 0 | 43.5 | 232.5 | 2.7 | 6.3 |

NOTE:

*Plastic elongation on loading

**Failed before reaching 0.2% plastic creep

***Top half of each ingot was homogenized @ 2150° F./4 hrs./A.C.

****Bottom half hot isostatic pressed @ 2125–2150° F./2 hrs./15 ksi Alloys CH21 and CH22 heat treated in vacuum @ 1950° F./1 hr. + 1400° F./5 hrs. furnace cool to 1200° F. @ 100° F./hr. + 1200° F./1 hr. Alloy CH23 heat treated @ 2050° F./1 hr. A.C. + 1600° F./4 hrs. A.C. Alloy CH24 heat treated @ 2150° F./1 hr. A.C. + 1600° F./4 hrs. A.C. + 1400° F./16 hrs. A.C.

The CH-22 alloy at 1300° F. exhibits values for ultimate tensile strength (UTS), 0.2% yield strength (YS), elongation (ELONG) and reduction of area (R.A.) comparable to the values displayed by specimens of IN 718 prepared as both Cast to Size (C.T.S.) and Cut from Casting (C.F.C.) specimens and tested at 1200° F. Manifestly the data displayed herein employs C.F.C. specimens of CH-22. The data for cast IN 718 is C.T.S. data, which is known to give higher test values than C.F.C. data. Thus, even on this disadvantageous basis of comparison the CH-22 alloy displays a 100° F. advantage over cast IN 718.

The CH-21 alloy exhibited lower tensile properties than CH-22, though it had a high tensile ductility indicating good weldability. The CH-23 and CH-24 alloys, which were compositional modifications of Rene '41 and Rene '63 respectively, displayed tensile and creep properties equivalent to the cast Rene' alloys. Notably, the lower carbon levels of these alloys do not appear to degrade the tensile and creep properties.

The creep rupture test data in TABLE IV display results at the test conditions of 1300° F./90 ksi during which the time varied from 22.8 hours to 232.5 hours.

Having established the superiority of cast CH-22 alloy relative to the other three cast alloys tested, a property comparison was made with IN 718 by testing these two cast superalloys in parallel. As established by high temperature tensile strength and stress rupture life tests shown in TABLE V and VI the CH-22 alloy shows a clear-cut advantage over IN 718. It should be noted that significantly greater loads were applied to the CH-22 specimen than to the IN 718 specimen in the stress rupture tests.

Compositional, ingot processing and thermal processing data follow. Tests were conducted on ~0.225" thick specimens.

ALLOY COMPOSITION

CH-22 (#33) - Ni-18Cr-12Co-3. OMo-5.ONb-3.OTa-1.OTi-0.5Al-0.01B–0.015C

IN 718 (#34) - Ni-19Cr-19Fe-3.OMo -5.lNb-0.9Ti-0.05Al-0.006B–0.003C

Ingot Processing

Vacuum Induction Melting

Casting: Cylindrical Cu mold 3⅝" diameter × 8½" length

HIP: 1150° C./15 ksi/4 hrs

Heat Treatment:

CH-22 (#33) - 1075° C., 1hr/water quench + 750° C., 8 hrs/furnace cool→650° C., 10 hrs/water quench IN 718 (#34) - 950° C., 1 hr/water quench + 720° C., 8 hrs/furnace cool→620° C., 10 hrs/water quench

TABLE V

| ALLOY | TEST TEMP. (°F.) | (Tensile) 0.2% YS (ksi) | UTS (ksi) | ELONG (%) | R.A. (%) |
|---|---|---|---|---|---|
| CH-22 | 1000 | 126 | 133 | 7.3 | 60 |
| (#33) | 1200 | 135 | 139 | 13 | 43 |
| IN 718 | 1000 | 111 | 121 | 16 | 19 |
| (#34) | 1200 | 115 | 118 | 12 | 62 |

TABLE VI

| ALLOY | TEST CONDITION | (Stress Rupture) Rupture Life (hr) | L.-M.* ($P_{25}$) | ELONG (%) | R.A. (%) |
|---|---|---|---|---|---|
| CH-22 | 1300° F./90 ksi | 118 | 47.65 | 6.0 | 7.4 |
| (#33) | 1200° F./100 ksi | 811** | 46.33 | 0.22 | — |
| IN 718 | 1300° F./75 ksi | 20 | 46.29 | 5.1 | 7.8 |
| (#34) | 1200° F./90 ksi | 214 | 45.37 | 6.7 | 9.8 |

*Larson-Miller rupture parameter

**Runout

In addition to the superior performance of the CH-22 alloy vs. IN 718 displayed for the parallel testing reported in TABLES V and VI, a comparison of TABLES III and V provides additional insight into the improved capabilities provided by alloys of this invention. Thus, the CH-22 alloy at 1300° F. (TABLE III) exhibits values for ultimate tensile strength (UTS), 0.2% yield strength (YS), elongation (ELONG) and reduction of area (R.A.) comparable to the values displayed by specimens of IN 718 at 1200° F. Manifestly, the cast CH-22 alloy (as heat treated for tests of TABLE III) exhibits a 100° F.+advantage over cast IN 718 (as heat treated for tests of TABLE V) for these parameters.

Phase stability studies were made on the unstressed samples after their exposure at various temperatures and times. After the heat treatment exposure, tensile specimens were machined and tested at 1300° F. to ascertain the effect of time and temperature on the stability of CH-22 alloy. The tensile properties of CH-22 alloy after long term exposure are set forth in TABLE VII below.

TABLE VII

| LONG TERM EXPOSURE | UTS (ksi) | 0.2% YS (ksi) | ELONG (%) | R.A. (%) |
|---|---|---|---|---|
| 1300° F./1000 hrs | 125 | 124 | 6.4 | 40 |
| | 132 | 131 | 8.3 | 35 |
| 1400° F./216 hrs | 134 | 126 | 7.8 | 7.7 |
| 1400° F./500 hrs | 118 | 108 | 3.3 | 5.2 |

Two rupture tests at 1300° F./90 ksi were conducted on exposed CH-22 smaples from the ingot prepared for tests reported in TABLES III and IV and the results (shown in TABLE VIIa) of these tests indicate that the rupture lives are longer than those of the unexposed samples of CH-22 (TABLE IV). These observations establish that alloys of this invention exhibit excellent thermal stability at temperatures up to 1300° F.

TABLE VIIa

| LONG TERM EXPOSURE | RUPTURE HOURS | ELONG (%) | R.A. (%) |
|---|---|---|---|
| 1300° F./1000 hrs | 194 | 5.6 | 12 |
| | 159 | 2.7 | 5.3 |

Comparison of TABLES VII and VIIa with TABLES III and IV suggest that the alloys of this invention can be heat treated to still further improve both their high temperature strength and their rupture properties. These properties are both of great value in alloys used in the manufacutre of turbine engine parts.

Figure 3:
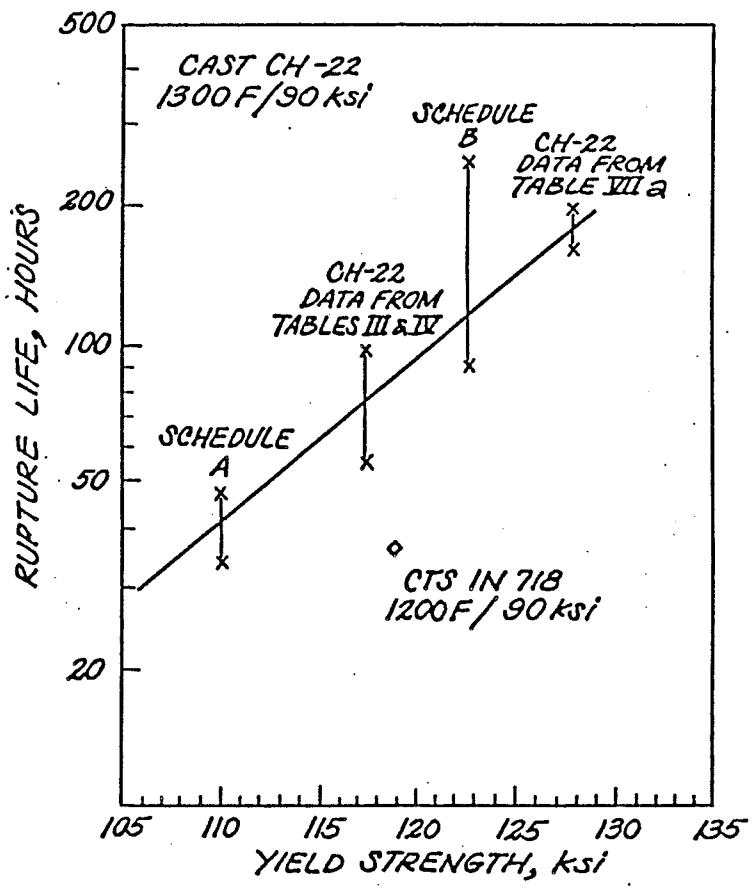
FIG. 3 is a graphic representation of the relationship between rupture life and yield strength of a cast optimal alloy composition subjected to a number of thermal processes.

Heat treatment and aging studies were performed on CH-22 alloy to identify and standardize thermal processing parameters for enhancing the strength and stress rupture life of alloys encompassed by this invention. The results of the effects of two thermal processes (Schedules A and B) on the tensile and rupture properties of CH-22 are shown in TABLE VIII. These results together with CH-22 data from TABLES III, IV and VIIa are displayed in FIG. 3. The heat treatment (solution anneal plus aging) of Schedule B is considered a feasible and very effective thermal processing sequence for the alloys of this invention. Results for the testing of IN 718 are located as a point on FIG. 3. Despite the significantly more severe rupture test conditions for the CH-22 alloy, the Schedule B heat treatment for this alloy produces (as compared to IN 718) an alloy of greater strength and significantly longer rupture life.

TABLE VIII

Heat Treatment:

Schedule A - 1075° C., 1 hr/W.Q. + 750° C., 8 hrs/F.C. → 650° C., 10 hrs/W.Q.

Schedule B - 1075° C., 1 hr/W.Q. + 775° C., 4 hrs/F.C. →

TABLE VIII-continued

700° C., 10 hrs/W.Q.

Tensile (1300° F.):

| | 0.2% YS (ksi) | UTS (ksi) | ELONG (%) | R.A. (%) |
|---|---|---|---|---|
| Schedule A | 111 | 116 | 16 | 44 |
| | 108 | 111 | 12 | 46 |
| Schedule B | 121 | 122 | 7 | 13 |
| | 124 | 129 | 26 | 64 |

Rupture (1300° F./90 ksi):

| | LIFE (hrs) | L.-S. Parameter $P_{25}$ | ELONG (%) | R.A. (%) |
|---|---|---|---|---|
| Schedule A | 48.1 | 46.96 | 4.7 | 11 |
| | 33.7 | 46.69 | 5.3 | 16 |
| Schedule B | 89.6 | 47.43 | 5.8 | 10 |
| | 247.4 | 48.21 | 5.1 | 12 |

Weldability tests were conducted on plates sliced (about 0.225 inch thick) from each ingot prepared for tests reported in TABLES III and IV in both the homogenized and hot isostatic pressed condition. Two grooves, each about ¾-inch wide were machined into one surface of each plate and two additional grooves were machined, spaced apart, into the opposite surface of the plate with top and bottom grooves being in alignment with each other. The stock remaining in the juxtaposed depressed regions was about 0.06 inches thick. A series of electron beam (EB) welds and tungsten inert gas (TIG) welds were made lengthwise of the 0.06 inch thick stock. Visual inspections were made for welding cracks before and after each welding pass and heat treatment employed subsequent to the welding. TABLE IX summarizes the results of these weldability tests.

TABLE IX (Number of Cracks Observed)

| | 1ST SERIES WELD | | AFTER HEAT TREATING WELDS | | 2ND SERIES WELDS | | AFTER HEAT TREATING WELDS | | 3RD SERIES WELDS | | AFTER HEAT TREATING WELD | |
|---|---|---|---|---|---|---|---|---|---|---|---|---|
| ALLOY | EB | TIG | EB | TIG | EB | TIG | EB | TIG | EB | TIG | EB | TIG |
| CH-21T* | No | No | No | No | No | No | No | No | No | 5 | No | 11 |
| CH-21BH** | 1 | 4 | 1 | 4 | | | | | | | | |
| CH-22T | No | No | No | No | No | No | No | No | No | 1 | No | 1 |
| CH-22BH | No | No | No | No | No | No | No | No | No | No | No | 2 |
| CH-23T | No | 4 | No | 5 | | | | | | | | |
| CH-23BH | No | No | No | No | | | | | | | | |
| CH-24T | No | 9 | No | 10 | | | | | | | | |
| CH-24BH | 9 | 2 | 1 | 10 | | | | | | | | |

*Top half of each ingot was homogenized @ 2150° F./4 hrs. A.C.

**Bottom half HIP'ed @ 2125-2150° F./2 hrs./15 ksi Alloys CH21 and CH22 heat treated in vacuum @ 1950° F./1 hr. + 1400° F./5 hrs., furnace cool to 1200° F. @ 100° F./hr. + 1200° F./1 hr. Alloy CH23 heat treated @ 2050° F./1 hr. A.C. + 1600° F./4 hrs. A.C. Alloy CH24 heat treated @ 2150° F./1 hr. A.C. + 1600° F./4 hrs. A.C. + 1400° F./16 hrs. A.C.

The CH-22 alloy was the most weldable alloy. Only one crack was observed in the TIG welding after the third-weld-plus-heat treating cycle. The CH-21 alloy is the next best alloy followed in turn by CH-23 and CH-24.

Another set of specimens for weldability tests were prepared as plates as described hereinabove and homogenized at 2150° F. for 4 hours. A series of EB welds and TIG welds were made in passes perpendicular to the grooves with all welds penetrating the plates. The EB passes each extended across both grooves; the TIG passes each extended across one of the grooves. Visual inspections were made for welding cracks after each welding pass. TABLE X summarizes the results of these weldability tests setting forth the number of cracks, if any, counted for each pass. These alloys identified in TABLE X as to at % TOTAL and $R_{gdp}$ are located on FIG. 5, which is the enlargement of a portion of FIG. 4. The balance of the contents of these alloy compositions are substantially the same as for the CH-22 alloy except that changes in (Al+Ti+Nb+Ta) are accomodated by varying the Ni content.

TABLE X

| ALLOY | at % TOTAL | $R_{gdp}$ | CRACKS EB WELDS | CRACKS TIG WELDS |
|---|---|---|---|---|
| HW-16 | 5.5 | 0.63 | 0 | 2 |
| HW-20 | 5.5 | 0.91 | 0 | 1 |
| HW-17 | 7.5 | 0.64 | 0 | 6 |
| HW-18 | 7.5 | 0.73 | 0 | 2 |
| HW-19 | 7.5 | 0.93 | 0 | 2 |
| CH-22 | | | 1 | 1 |
| CH-22 (#33) | | | 0 | 1 |
| IN-718 (#34) | | | 9 | 3 |

Interestingly, the Al+Ti levels in nickel-base alloys may be the most important variable affecting the weldability. The lower the level of Al+Ti, the better the weldability of nickel-base alloys becomes. Lowering the Al +Ti level below 2 wt % appears to be beneficial to achieve good weldability. Differences in weldability appear to exist between hot isostatic pressed specimens and homogenized specimens depending upon the alloy investigated. The benefits of the alloying system of this invention are optimized in the specific combination of elements in which quantities of cobalt and tantalum are substituted for the iron content of the base alloy and $\gamma''$ phase material having a preselected relationship of at % (Al+Ti) to at % (Nb+Ta) is selected as the sole precipitation strengthening mechanism.

Figure 4:
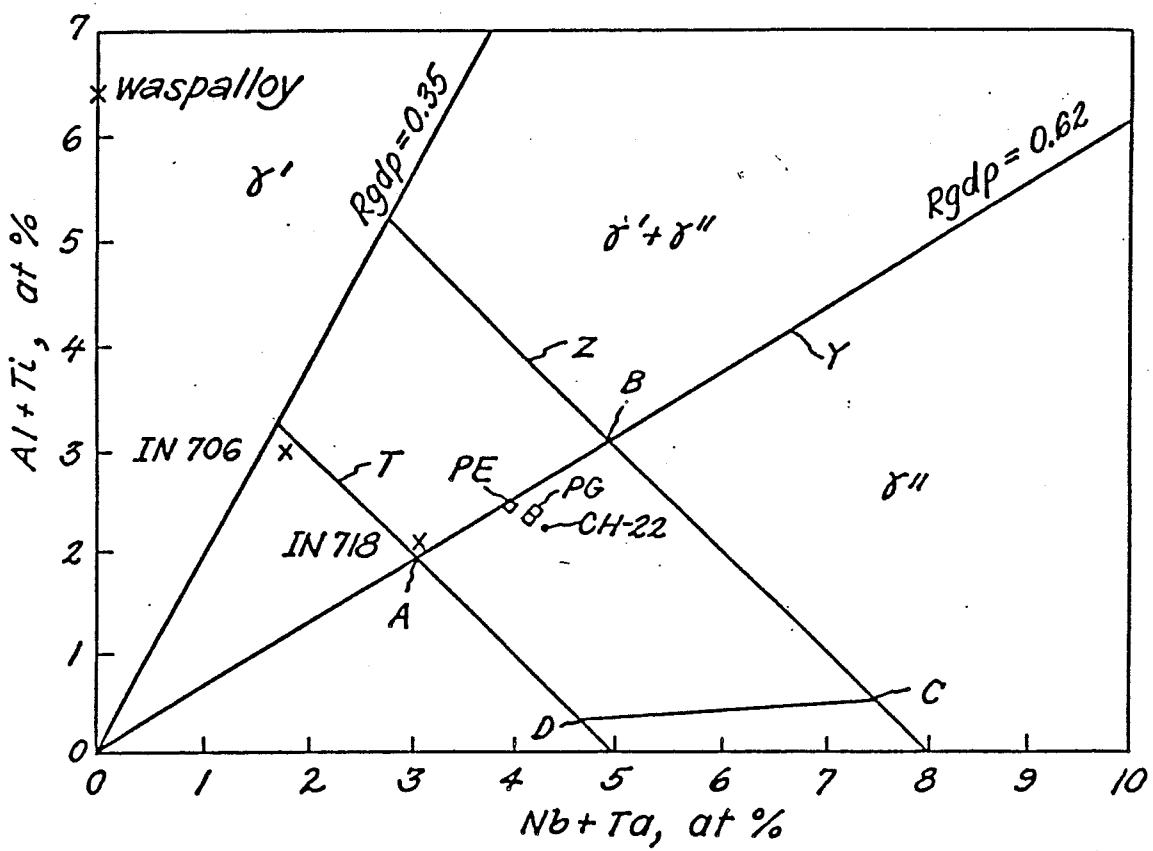
FIG. 4 is a graph schematically displaying the relationships between (Al+Ti) and (Nb+Ta), expressed in at %, required for the production of weldable alloys according to this invention.
Figure 5:
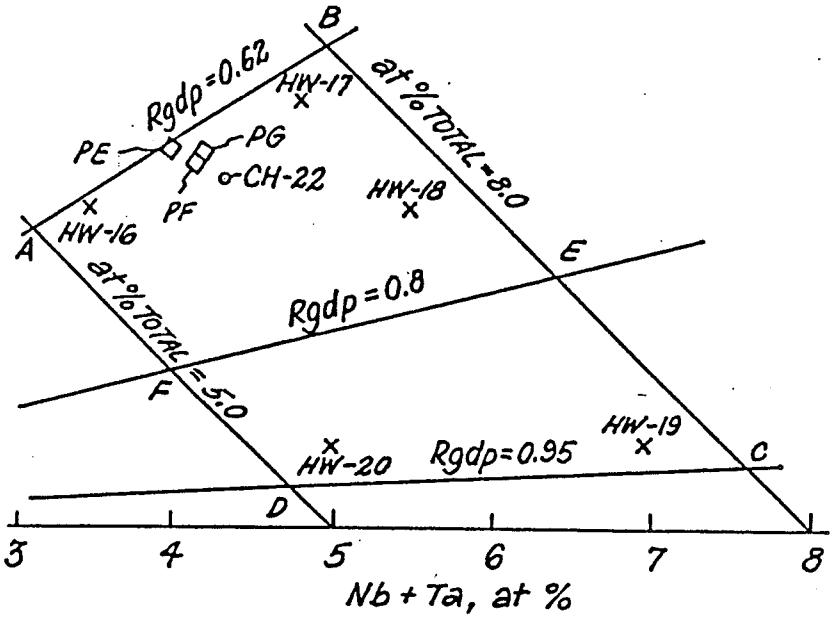
FIG. 5 is an enlargement of the portion of FIG. 4 bounded by ABCDA.

The particular relationships between at % (Al+Ti) and at % (Nb+Ta), which contribute to the excellent weldability characteristics of the alloy system of this invention are defined in FIGS. 4 and 5 and discussion related thereto. It must be appreciated that each of the defining lines displayed in FIGS. 4 and 5 actually represents a thin longitudinally-extending band to account for the inevitable errors encountered in the chemical analyses made to acquire the data establishing these lines. Lines W and Y, which pass through the origin of the graph, delineate three different precipitation strengthening mechanisms (i.e., all $\gamma'$, $\gamma'$ mixed with $\gamma''$, and all $\gamma''$). The mixed $\gamma'+\gamma''$ mechanism prevails when the value of $R_{gdp}$ is between about 0.35 and about 0.62, and IN 718 falls into this region of FIG. 4. In addition to having only $\gamma''$ phase as the precipitation strengthening material, another criterion displayed in FIGS. 4 and 5 is to be met for alloys of this invention for which optimum weldability is desired. Thus, the value of at % TOTAL for such alloys is to be equal to or greater than about 5.0 (line T) and be equal to or less than about 8.0 (line Z).

Applying these criteria, it can be seen from FIGS. 4 and 5 that the (Al+Ti) to (Nb+Ta) relationships most broadly encompassed within this invention fall approximately within the area ABCDA. Preferred compositions fall approximately within the area of the quadrilateral A, B, E, F, A. Representative weldable alloys in addition to CH-22 are set forth in TABLE XI. These alloys were cast and subjected to microscopic examination whereby it was determined that $\gamma''$ phase was the only precipitation strengthening phase present therein. This information was utilized in locating line Y.

In addition to data points for PE, PF, PG and CH-22, the data points for IN 718, Waspalloy and IN 706 are plotted on FIG. 4.

TABLE XI

| Precipitate Designation | Ni | Cr | Co | Fe | Mo | Al | Ti | Ta | Nb | Zr | B | Al + Ti (at %) | Nb + Ta (at %) | at % TOTAL | R |
|---|---|---|---|---|---|---|---|---|---|---|---|---|---|---|---|
| " PE wt % | bal. | 19.0 | 13.0 | — | 4.0 | 0.5 | 1.0 | 6.0 | 3.0 | 0.05 | 0.01 | | | | |
| at % | | 22.22 | 13.42 | — | 2.54 | 1.13 | 1.27 | 2.02 | 1.96 | 0.03 | 0.06 | 2.40 | 3.98 | 6.38 | 0.62 |
| " PF wt % | bal. | 18.0 | — | 18.0 | 3.0 | 0.5 | 1.0 | 3.0 | 5.0 | — | 0.01 | | | | |
| at % | | 20.51 | — | 19.1 | 1.85 | 1.10 | 1.24 | 0.98 | 3.19 | — | 0.06 | 2.34 | 4.17 | 6.51 | 0.64 |
| " PG wt % | bal. | 18.0 | — | — | 3.0 | 0.5 | 1.0 | 3.0 | 5.0 | — | 0.01 | | | | |
| at % | | 20.71 | — | — | 1.87 | 1.11 | 1.25 | 0.99 | 3.22 | — | 0.06 | 2.36 | 4.21 | 6.57 | 0.64 |

The numerical expression for the relationships set forth in FIGS. 4 and 5 for ABCDA are as follows:

| | at % | wt % |
|---|---|---|
| Al | 0 to about 3.05 | 0 to about 1.45 |
| Ti | 0 to about 3.05 | 0 to about 2.54 |
| Al + Ti | 0.5 to about 3.05 | 0.24 to about 2.54 |
| Nb | 0 to about 6.75 | 0 to about 10.1 |
| Ta | 0.75 to about 7.50 | 2.25 to about 22.5 |
| Nb + Ta | 3.1 to about 7.50 | 4.70 to about 22.5 |

Similarly the numerical expressions for the more preferred relationships of A, B, E, F, A are as follows:

| | at % | wt % |
|---|---|---|
| Al + Ti | 1.0 to about 3.05 | 0.48 to about 2.54 |
| Nb | 0 to about 5.65 | 0 to about 8.56 |
| Ta | 0.75 to about 6.4 | 2.25 to about 19.4 |
| Nb + Ta | 3.1 to about 6.4 | 4.70 to about 19.4 |

The most preferred values are the following in which the Al to Ti ratio is about 1:1 and the Nb to Ta ratio is about 1:0.3:

| | at % | wt % |
|---|---|---|
| Al | 0.95 to 1.50 | 0.45 to 0.71 |
| Ti | 0.95 to 1.50 | 0.79 to 1.25 |
| Nb | 2.38 to 4.69 | 3.61 to 7.11 |
| Ta | 0.75 to 1.41 | 2.25 to 4.27 |

Figure 6:
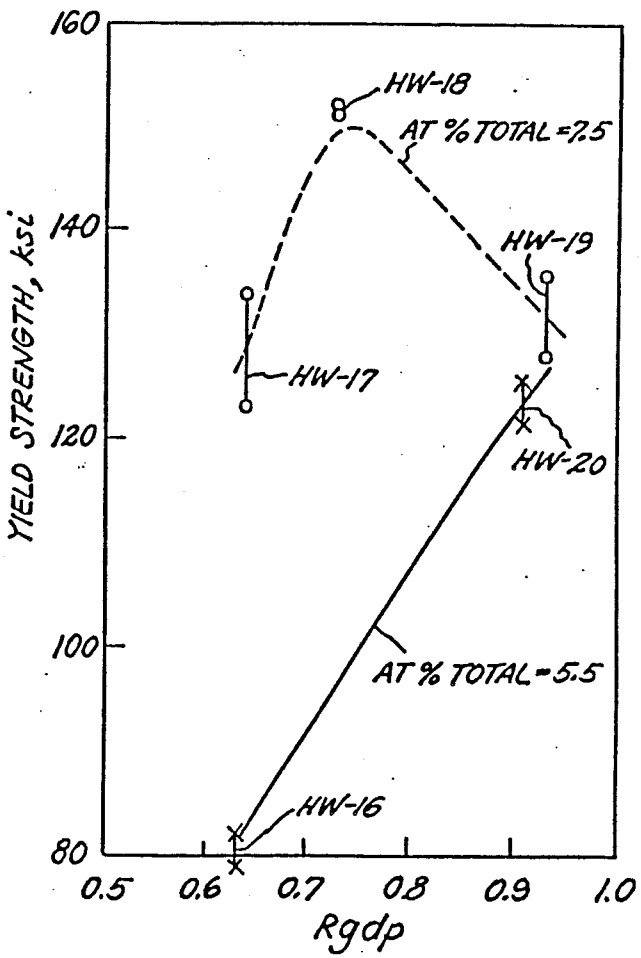
FIG. 6 is a graphic representation of yield strength (0.2% YS) data obtained in tests at 1300° F. for compositions HW-16 through HW-20 located in region ABCDA of FIG. 4.
Figure 7:
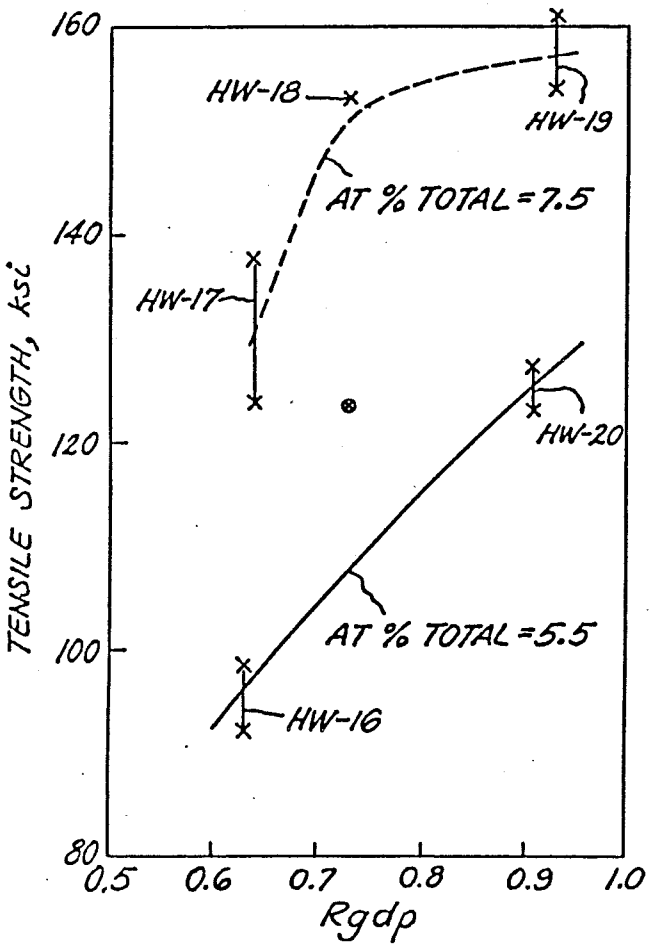
FIG. 7 is a graphic representation of tensile strength (UTS) data obtained in tests at 1300° F. for the same compositions for which data are given in FIG. 6.

Yield strength tensile strength and rupture life tests were conducted using alloys Hw-16 through HW-20 located within the compass of area ABCDA (FIG. 5) and also identified in TABLE IIX both as to at % TOTAL and $R_{gdp}$. Changes in (Al+Ti+Nb+Ta) are accomplished by varying the Ni content. Changes in (Nb+Ta) content as a function of at % TOTAL are plotted as $R_{gdp}$ in the graphs of FIGS. 6 and 7. Two tests were performed at 1300° F. for each sample composition and the results of the yield and tensile tests conducted are set forth in TABLE XII and displayed in FIGS. 6 and 7, respectively. The temperature and extent of heat treatment for each alloy is shown below TABLE XII.

TABLE XII

| ALLOY | at % TOTAL | $R_{gdp}$ | 0.2% YS (ksi) | UTS (ksi) | ELONG (%) |
|---|---|---|---|---|---|
| HW-16 | 5.5 | .63 | 79.4 | 92.4 | 14.2 |
| | | | 82.3 | 98.7 | 17.0 |
| HW-20 | 5.5 | .91 | 125.6 | 127.8 | 2.9 |
| | | | 121.5 | 123.4 | 7.5 |
| HW-17 | 7.5 | .64 | 122.8 | 123.8 | 5.3 |
| | | | 133.9 | 137.6 | 5.2 |
| HW-18 | 7.5 | .73 | 151.3 | 152.7 | 5.9 |
| | | | 151.5 | 153.2 | 5.2 |
| HW-19 | 7.5 | .93 | 127.8 | 153.8 | 10.7 |
| | | | 135.6 | 161.3 | 7.8 |

HEAT TREATMENT:

| | HW-16 | HW-17 | HW-18 | HW-19 | HW-20 |
|---|---|---|---|---|---|
| Solution (1 hr) | 975C | 1100C | 1125C | 1075C | 1025C |
| Aging | 775C/4 hr + 700/10 hr | | | | |

The results of the rupture tests are shown in TABLE XIII. Tests conditions were 1300° F. and 90 ksi. The test data is re-cast in TABLE XIV in order to better reflect the regions of area ABCDA in which the (Nb+Ta) and at % TOTAL will provide improved rupture life.

TABLE XIII

| ALLOY | RUPTURE LIFE (hr) | ELONG (%) | R.A. (%) |
|---|---|---|---|
| HW-16 | 115 | 6.2 | 19 |
| (J) | 6.6 | 4.0 | 9.2 |
| HW-20 | 34.5 | 3.6 | 7.5 |
| (N) | 1.0 | 3.8 | 8.0 |
| HW-17 | 99.1 | 2.9 | 5.3 |
| (K) | 78.7 | 2.4 | 2.4 |
| HW-18 | 69.8 | 2.0 | 3.8 |
| (Q) | 65.8 | 2.0 | 8.6 |
| HW-19 | 53.4 | 5.6 | 10 |
| (P) | 45.3 | 6.0 | 13 |

TABLE XIV

| $R_{gdp}$ | RUPTURE LIFE (hr) FOR at % TOTAL = 5.5 | RUPTURE LIFE (hr) FOR at % TOTAL = 7.5 |
|---|---|---|
| 0.63 | 115/6.6 | 99.1/78.7 |
| 0.73 | | 69.8/65.8 |
| 0.93 | 34.5/1.0 | 53.4/45.3 |

Figure 8:
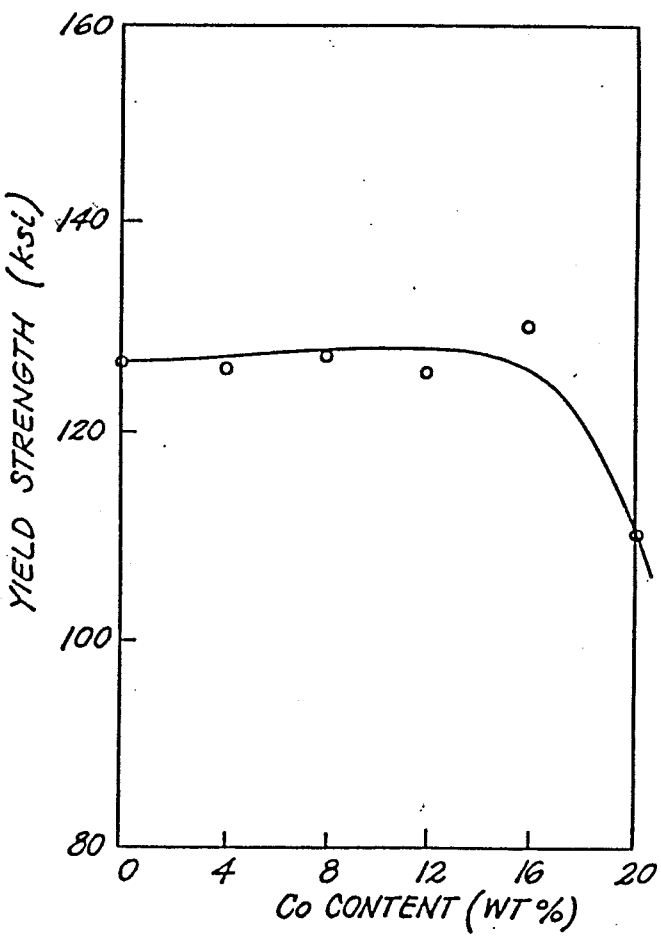
FIG. 8 is a graphic representation of yield strength (0.2% YS) data obtained for compositions HW-10 through HW-15 to demonstrate the changes in this parameter with changes in cobalt content, the tests being conducted at 1300° F. on sample previously annealed and aged.
Figure 10:
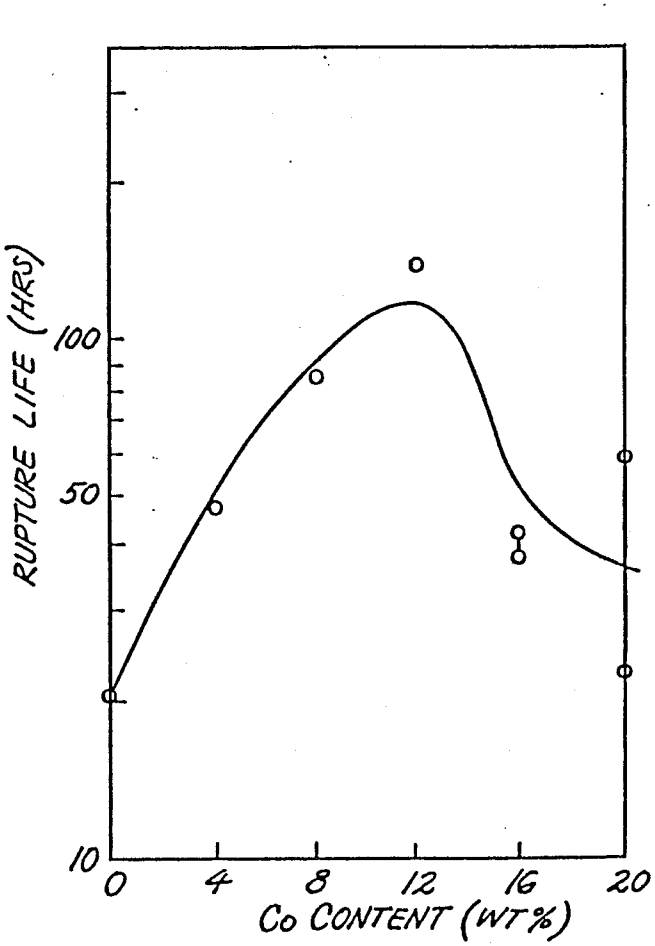
FIG. 10 is a graphic representation of rupture life data obtained for the same compositions for which data are given in FIG. 8, the tests being conducted at 1300° F. and 90 ksi on samples previously annealed and aged.
Figure 9:
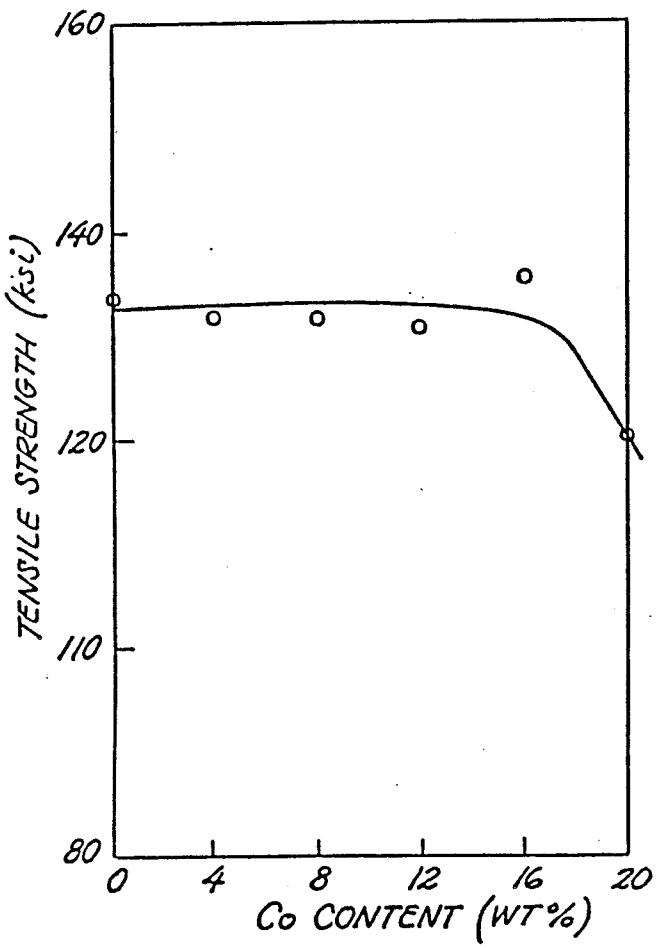
FIG. 9 is a graphic representation of tensile strength (UTS) data obtained for the same compositions for which data are given in FIG. 8, the tests being conducted at 1300° F. on samples previously annealed and aged.

Tests were conducted to determine the optimum range of Co. The balance of the cntents of these alloys (HW-10 through HW-15) are substantially the same as for the CH-22 alloy except that changes in Co content are accomodated by varying the Ni content. The results of yield strength and tensile strength tests are reported in TABLE XV and displayed in FIGS. 8 and 9, respectively. Samples were annealed and aged as indicated below TABLE XV and the tests were conducted at 1300° F. Results of the rupture tests are shown in TABLE XVI and are displayed in FIG. 10.

TABLE XV

| ALLOY | COBALT (wt %) | 0.2% YS (ksi) | UTS (ksi) | ELONG (%) |
|---|---|---|---|---|
| HW-10 | 0.00 | 127.0 | 133.5 | 20.9 |
| HW-11 | 4.00 | 126.2 | 131.9 | 10.6 |
| HW-12 | 8.00 | 127.2 | 131.8 | 10.0 |
| HW-13 | 12.00 | 125.6 | 130.3 | 8.1 |
| HW-14 | 16.00 | 130.0 | 135.6 | 9.9 |

TABLE XV-continued

| ALLOY | COBALT (wt %) | 0.2% YS (ksi) | UTS (ksi) | ELONG (%) |
|---|---|---|---|---|
| HW-15 | 20.00 | 109.8 | 120.9 | 14.4 |

HEAT TREATMENT; 1075C/1 hr.+750C/8 hr+650C/10 hr

TABLE XVI

| ALLOY | COBALT (wt) | RUPTURE LIFE (hr) | ELONG (%) |
|---|---|---|---|
| HW-10 | 0.00 | 20.27 | 5.8 |
| HW-11 | 4.00 | 47.14 | 4.7 |
| HW-12 | 8.00 | 85.15 | 3.8 |
| HW-13 | 12.00 | 138.18 | 5.3 |
| HW-14 | 16.00 | 42.23 | 5.6 |
| | | 37.46 | 4.2 |
| HW-15 | 20.00 | 22.78 | 7.1 |
| | | 71.37 | 5.1 |

HEAT TREATMENT; 1075C/1 hr+750C/8 hr+650C/10 hr

Figure 12:
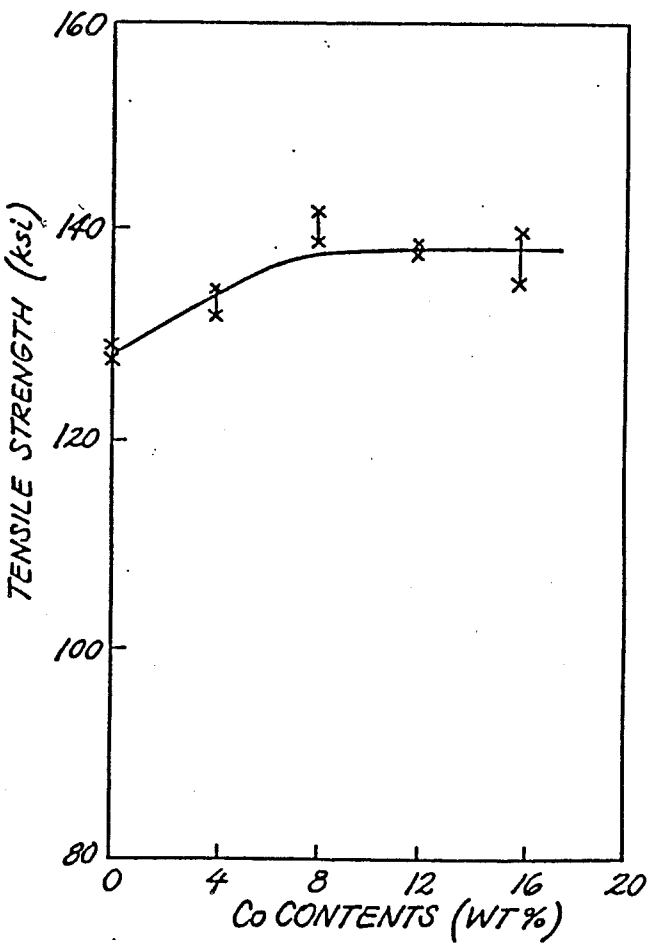
FIG. 12 is a graphic representation of tensile strength (UTS) data obtained for the same compositions for which data are given in FIG. 11, the tests being conducted at 1300° F. on samples previously exposed to 1300° F. for 1000 hrs.
Figure 11:
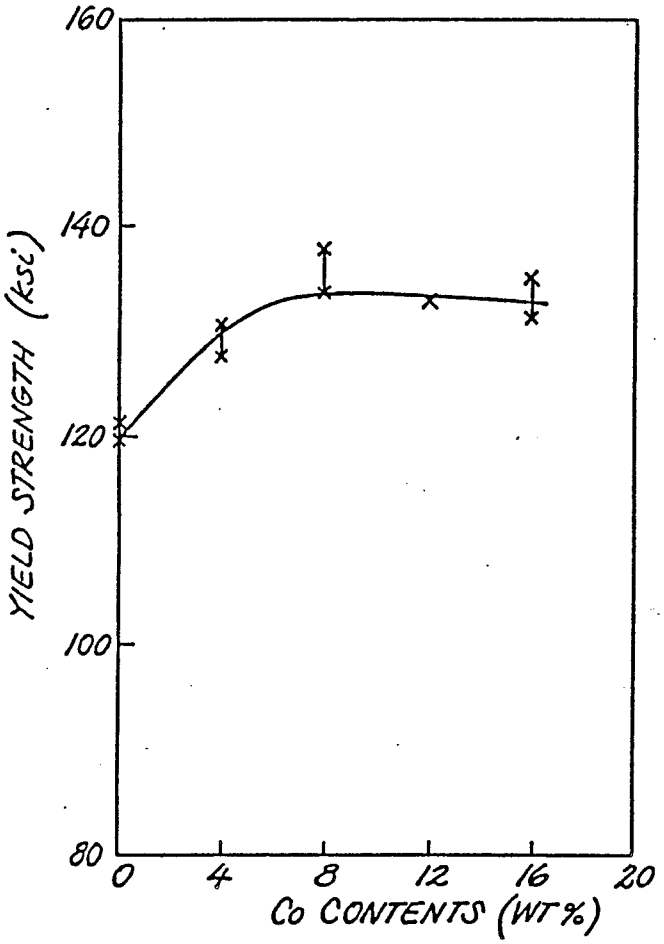
FIG. 11 is a graphic representation of yield strength (0.2% YS) data obtained in tests similar to those conducted in FIG. 8, the tests being conducted at 1300° F. on samples previously exposed to 1300° F. for 1000 hrs.
Figure 13:
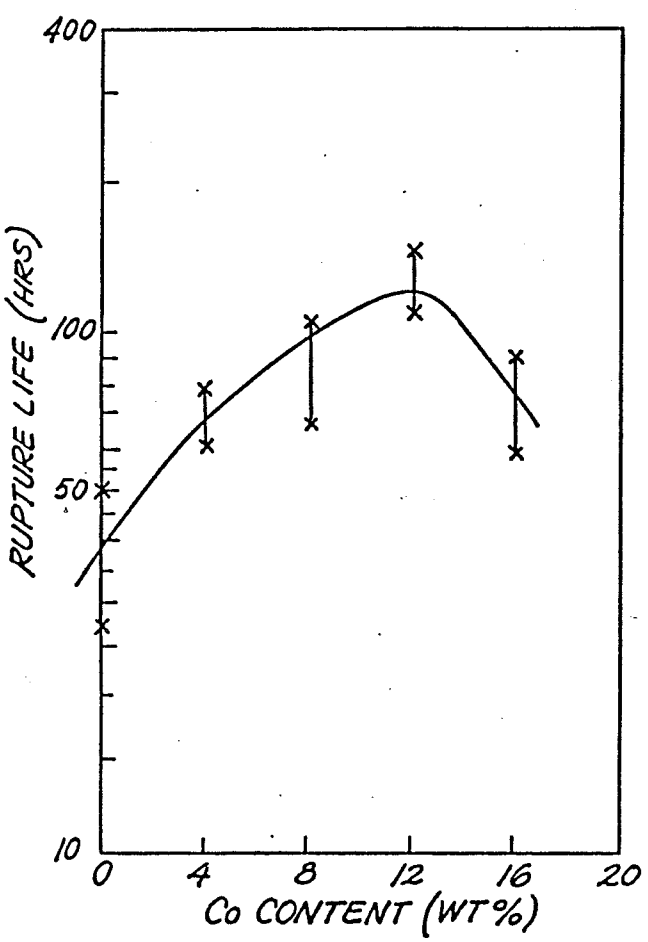
FIG. 13 is a graphic representation of rupture life data obtained for the same compositions for which data are given in FIG. 11, the tests being conducted at 1300° F. and 90 ksi on samples previously exposed to 1300° F. for 1000 hrs.

Sampels of the same composition were tested at 1300° F., the samples having been exposed for 1000 hrs at 1300° F. Results of yield and tensile tests are shown in TABLE XVII and displayed in FIGS. 11 and 12, respectively. Stress rupture tests on samples of the same composition subjected to the same heat treatment are reported in TABLE XVIII and shown in FIG. 13. Tests were conducted at 1300° F. and 90 ksi.

TABLE XVII

| ALLOY | COBALT (wt %) | 0.2% YS (ksi) | UTS (ksi) | ELONG (%) |
|---|---|---|---|---|
| HW-10 | 0.00 | 120.6 | 128.8 | 14.5 |
| | | 121.3 | 128.1 | 20.6 |
| HW-11 | 4.00 | 128.1 | 134.1 | 9.0 |
| | | 131.0 | 131.9 | 12.2 |
| HW-12 | 8.00 | 138.9 | 141.8 | 8.1 |
| | | 134.0 | 138.5 | 8.8 |
| HW-13 | 12.00 | 133.5 | 137.6 | 3.7 |
| HW-14 | 16.00 | 135.4 | 139.7 | 6.0 |
| | | 131.4 | 135.1 | 7.0 |

TABLE XVIII

| ALLOY | COBALT (wt %) | RUPTURE LIFE (hr) | ELONG (%) |
|---|---|---|---|
| HW-10 | 0.00 | 51.14 | 3.8 |
| | | 27.95 | 4.4 |
| HW-11 | 4.00 | 60.58 | 4.0 |
| | | 79.53 | 2.4 |
| HW-12 | 8.00 | 107.12 | 4.4 |
| | | 67.94 | 2.9 |
| HW-13 | 12.00 | 112.72 | 3.3 |
| | | 147.64 | 4.2 |
| HW-14 | 16.00 | 60.41 | 3.3 |
| | | 93.18 | 2.7 |

Figure 14:
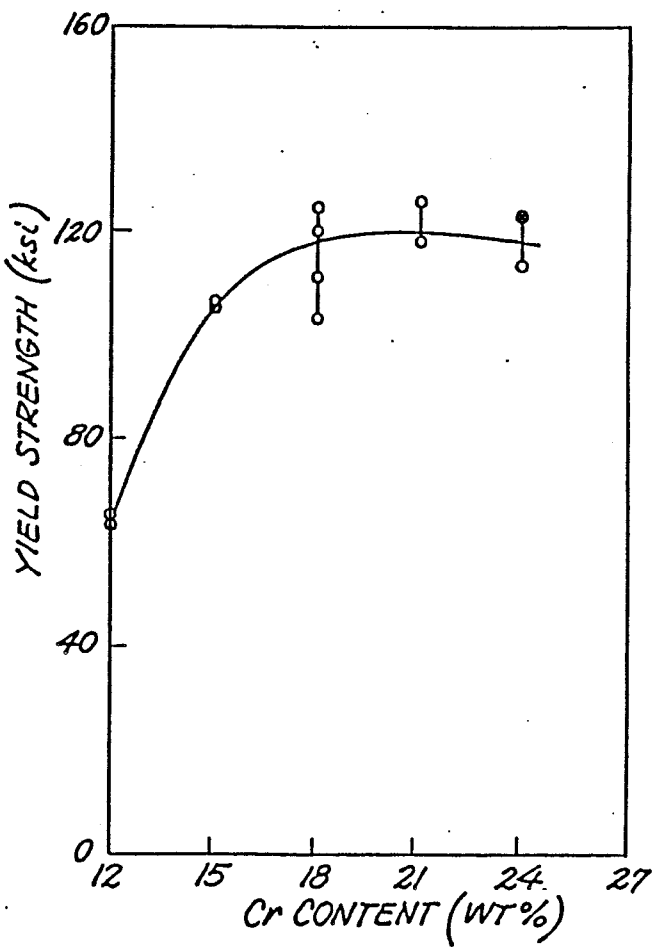
FIG. 14 is a graphic representation of yield strength (0.2% YS) data obtained for compositions HW-40 through HW-45 to demonstrate the changes in this parameter with changes in chromium content, the tests being conducted at 1300° F. on samples previously annealed and aged.
Figure 15:
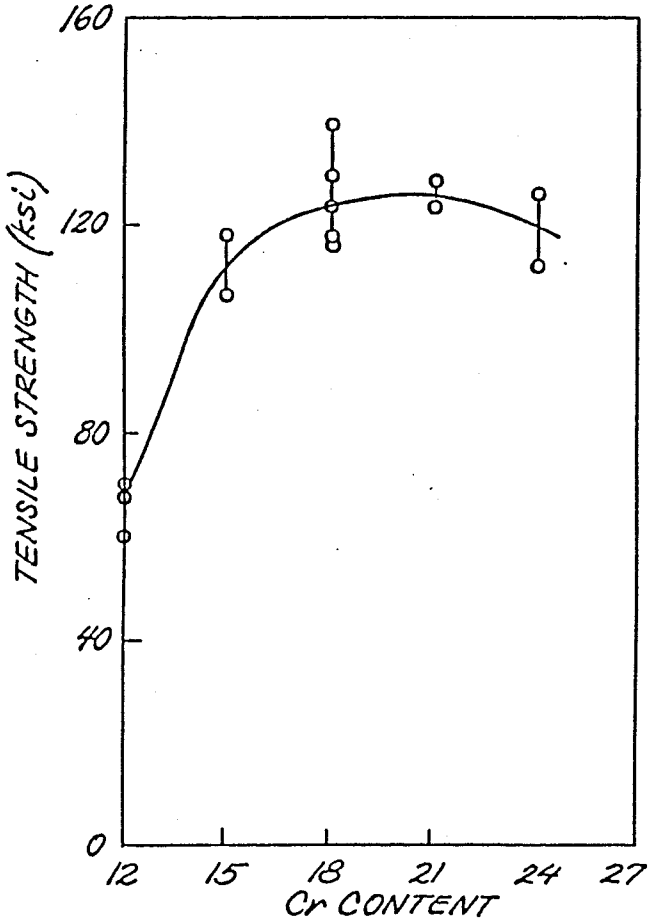
FIG. 15 is a graphic representation of tensile strength (UTS) data obtained for the same compositions for which data are given in FIG. 14, the tests being conducted at 1300° F. on samples previously annealed and aged.
Figure 16:
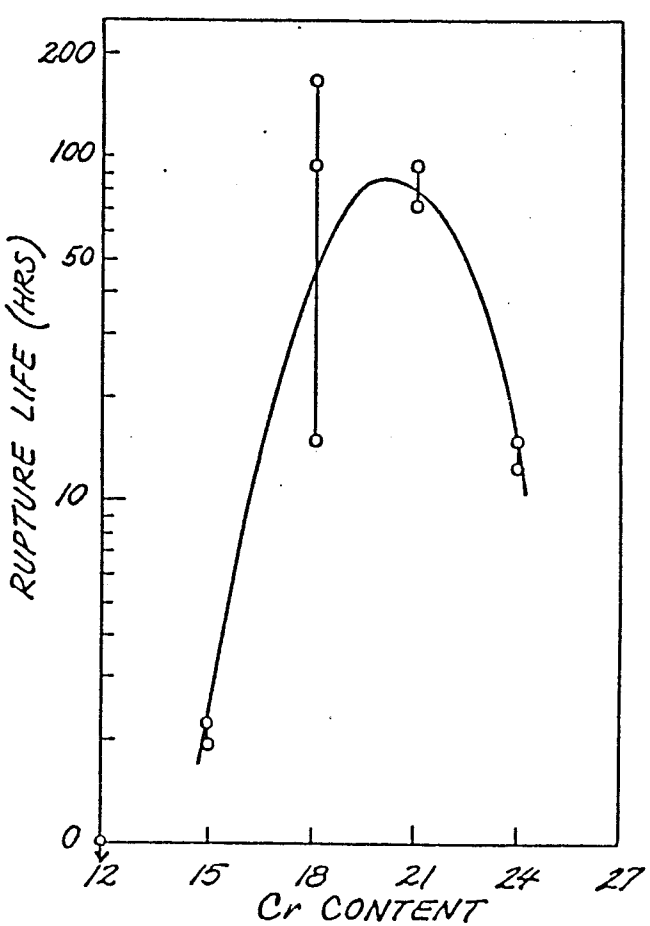
FIG. 16 is a graphic representation of rupture life data obtained for the same compositions for which data are given in FIG. 14, the tests being conducted at 1300° F. and 90 ksi on samples previously annealed and aged.

Additional tests were conducted using alloys HW-40 through HW-45. The balance of the contents of alloys HW-40 through HW-44 are substantially the same as for CH-22, except that the Nb and Ta contents of these alloys were 6.5 wt % and 0 wt %, respectively, while the composition for HW-45 is the same as the composition of CH-22. Yield strength and tensile strength data for all these alloys are set forth in TABLE XIX and in FIGS. 14 and 15, respectively. The data from rupture life tests conducted at 1300° F. and 90 ksi are reported in TABLE XX and in FIG. 16.

TABLE XIX

| ALLOY | CHROMIUM (wt %) | 0.2% YS (ksi) | UTS (ksi) | ELONG (%) |
|---|---|---|---|---|
| HW-40 | 12.0 | 53.1 | 69.4 | 39.2 |
| | | 54.8 | 67.5 | 32.4 |
| HW-41 | 15.0 | 105.7 | 117.5 | 19.7 |
| | | 105.3 | 106.5 | 9.0 |
| HW-42 | 18.0 | 111.4 | 117.3 | 12.8 |
| | | 124.1 | 129.4 | 9.3 |
| HW-43 | 21.0 | 118.4 | 123.8 | 7.2 |
| | | 124.7 | 127.8 | 6.1 |
| HW-44 | 24.0 | 112.7 | 113.3 | 6.4 |
| | | 122.8 | 125.9 | 10.8 |
| HW-45 | 18.0 | 119.0 | 124.0 | 7.5 |
| | | 102.2 | 116.5 | 4.5 |

HEAT TREATMENT; 1075C/1 hr+750C/8 hr+650C/10 hr

TABLE XX

| ALLOY | CHROMIUM (wt %) | LIFE (hr) | ELONG (%) |
|---|---|---|---|
| HW-40 | 12.0 | 0.00 | 28.0 |
| | | 0.00 | 19.0 |
| HW-41 | 15.0 | 2.20 | 5.6 |
| | | 1.95 | 3.1 |
| HW-42 | 18.0 | 88.75 | 15.0 |
| | | 14.94 | 3.1 |
| HW-43 | 21.0 | 91.86 | 3.1 |
| | | 74.05 | 8.4 |
| HW-44 | 24.0 | 12.48 | 3.6 |
| | | 14.43 | 4.2 |
| HW-45 | 18.0 | 165.18 | 7.8 |
| | | 90.24 | 3.1 |

HEAT TREATMENT: 1075C/1 hr+750C/8 hr+650C/10 hr

In a more preferred composition, the nickel-base alloy of this invention is substantially free of iron and contains (in wt %) about 16% to about 22% chromium, about 8% to about 14% cobalt, about 2.8% to about 3.0% molybdenum, about 2.5% to about 3.5% tantalum, about 4.5% to about 5.5% niobium, about 0.3% to about 0.7% aluminum, about 0.8% to about 1.2% titanium, about 0.005% to about 0.015% boron, up to 0.03% carbon and the balance essentially nickel. In the optimized composition (with $R_{gdp}$ equal to or greater than 0.62 and equal to or less than 0.95 and at % TOTAL in between about 5.0 and about 8.0) the minimum content (in at %) of Al+Ti is about 1.9% and the minimum content (in at %) of Nb+Ta is about 3.1%. The maximum content (in at %) of Al+Ti is about 3.0% and the maximum content (in at %) of Nb+Ta is about 6.1%. In this optimized composition the balance of the contents of the alloy will be substantially the same as for the CH-22 alloy (except that W may be substituted for some of the Mo) with the balance essentially Ni. The best mode of this invention as it is now known is the composition of CH-22 (in wt %): Ni-18Cr-12Co-3Mo-5Nb -3Ta-1Ti-0.5A-0.01B-0.015C. The preferred compositional relationships between aluminum and titanium and between niobium and tantalum, when expressed in at %, is the following: Al:Ti is about 1:1 and Nb:Ta is about 1:0.3.

The data presented herein define the following relationships between weldability and at % TOTAL and $R_{gdp}$ (the content of Al, Ti, Nb and Ta being set thereby) within the area ABCDA:

1. weldability improves as at % TOTAL is decreased and 2. weldability improves as $R_{dgp}$ is increased.

Similarly, the effect of Co and Cr content on yield strength (0.2% YS), tasnsile strength (UTS) and stress rupture life establishes that given the CH-22 composition of other components, optimum high temperature strength and stress rupture life are obtained by using contents of Co in the range of about 8 to about 14 wt % and/or by using contents of Cr in the range of about 16 to about 22 wt %.

Unless otherwise specified, percentages given are in weight percent.

What I claim as new and desire to secure by Letters Patent of the United States is:

1. A substantially iron-free nickel-base alloy consisting essentially of, in weight percent:
   about 12% to 24% chromium,
   about 5% to 20% cobalt;
   about 1% to 8.5% of at least one member of the group consisting of molybdenum, tungsten, and rhenium;
   about 2% to 23% tantalum;
   about 0.003% to 0.05% boron;
   less than about 1% iron;
   and the balance essentially nickel said alloy having a rupture life of at least 100 hours at a stress of 90 ksi at 1300 ° F. and a substantial volume fraction of gamma double prime phase.

2. A substantially iron-free nickel-base alloy consisting essentially of, in weight percent:
   about 12% to 24% chromium;
   about 5% to 20% cobalt;
   about 1% to 8.5% of a member of the group consisting of molybdenum, tungsten, and rhenium;
   about 2% to 23% tantalum;
   up to about 10.5% niobium;
   up to about 2.7% aluminum;
   up to about 3.7% titanium;
   about 0.003% to 0.05% boron;
   up to about 0.10% carbon;
   up to about 0.1% zirconium;
   up to about 1% iron;
   up to about 0.5% silicon;
   up to about 0.5% manganese; said alloy having a rupture life of at least 100 hours when subjected to a stress of 90 ksi at 1300° F.

3. A substantially iron-free nickel-base alloy according to claim 1 wherein the sum of the atomic percent of niobium plus tantalum divided by sum of atomic percent of aluminum, titanium, niobium and tantalum is 0.62 or greater.

4. A nickel-base alloy of improved weldability consisting essentially, in weight percent, of:
   about 12% to 24% chromium;
   about 8% to 14% cobalt;
   about 1% to 8.5% of at least one member of the group consisting of molybedenum, tungsten, and rhenium;
   about 2.5% to 4.5% tantalum;
   about 0.003% to 0.05% boron;
   less than about 1% iron;
   up to about 10.5% niobium;
   up to about 2.7% aluminum;
   up to about 3.7% titanium;
   up to about 0.10% carbon;
   up to about 0.1% zirconium;
   up to about 0.5% silicon
   up to about 0.5% manganese;
   and the balance essentially nickel, said alloy having a rupture life of at leat 100 hours at a stress of 90 ksi at 1300° F. and in the cast and heat treated condition a 0.2% yield strength of at least 115 ksi an ultimate tensile strength of at least 125 ksi at 1300° F., and a substantial volume fraction of gamma double prime phase.

5. A nickel-base alloy according to claim 1 consisting essentially of, in weight percent:
about 16% to 22% chromium;
about 8% to 14% cobalt;
about 2.8% to 3.4% molybdenum;
about 4.5% to 5.5% niobium;
about 2.5% to 3.5% tantalum;
about 0.8% to 1.2% titanium;
about 0.3% to 0.7% aluminum;
about 0.003% to 0.015% boron;
up to about 0.04% carbon;
up to about 0.1% zirconium;
up to about 1% iron;
up to about 0.5% silicon;
up to about 0.5% manganese;
and the balance essentially nickel.

6. The nickel-base alloy of claim 5 wherein the sum-content of aluminum plus titanium is from about 0.24% to about 2.54%, by weight, and the sum-content of niobium plus tantalum is from about 4.7% to about 19.4%, by weight.

7. The nickel-base alloy of claim 5 wherein the atomic percent ratio of aluminum to titanium is about 1:1 and the atomic percent ratio of niobium to tantalum is about 1:0.3.

8. The nickel-base alloy of claim 5 wherein said alloy contains aluminum, titanium and niobium, as well as tantalum, the ratio of aluminum to titanium (at %) is about 2.1:1.2 and the ratio of niobium to tantalum (at %) is about 0.66:0.09.

9. A substantially iron-free nickel-base alloy having improved weldability consisting essentially of, by weight percent:
about 12% to 24% chromium;
about 5% to 20% cobalt;
about 1% to 8.5% of at least one member of the group consisting of molybdenum, tungsten and rhenium;
up to about 1% iron;
about 2% to 23% tantalum;
about 0.003% to 0.05% boron;
and the balance essentially nickel wherein the sum content, in atomic percent of aluminum plus titanium is from about 0.5 to about 3.0 and the sum content, in atomic percent, of niobium plus tantalum is from about 3.0 to about 7.5 and the value of the sum of the atomic percent of aluminum, titanium, niobium, and tantalum is from about 0.62 to about 0.95, and wherein said alloy in the forged and heat treated condition has a rupture life of at least 1800 hours when subjected to a stress of 120 ksi at 1200° F.

10. A cast article of manufacture of a substantially iron-free nickel-base alloy consisting essentially of, in weight percent:
about 12% to 24% chromium;
about 5% to 20% cobalt;
about 1% to 8% of a member of the group consisting of molybdenum, tungsten, and rhenium;
about 2% to 23% tantalum;
up to about 10.5 niobium;
up to about 2.7% aluminum;
up to about 3.7% titanium;
about 0.003% to 0.05% boron;
up to about 0.10% carbon;
up to about 0.1% zirconium;
up to about 1% iron;
up to about 0.5% silicon;
up to about 0.5% manganese;
the balance being essentially nickel, said alloy having a rupture life of at least 100 hours when subjected to a stress of 90 ksi at 1300° F., said article being characterized by the presence of a substantial volume fraction of gamma double prime phase.

* * * * *